United States Patent [19]

Nomura et al.

[11] Patent Number: 5,001,515

[45] Date of Patent: Mar. 19, 1991

[54] IMAGE FORMING APPARATUS AND IMAGE FORMING UNIT MOUNTABLE ON SAME

[75] Inventors: Akihiro Nomura; Yasuo Miyauchi, both of Yokohama; Akio Takeda, Kawasaki; Haruo Uchida, Yokohama; Yasutsugu Saijo, Tokyo, all of Japan

[73] Assignee: Canon Kabushiki Kaisha, Tokyo, Japan

[21] Appl. No.: 391,313

[22] Filed: Aug. 9, 1989

[30] Foreign Application Priority Data

Aug. 12, 1988 [JP] Japan ..... 63-200179
Sep. 5, 1988 [JP] Japan ..... 63-220481

[51] Int. Cl.[5] ..... G03G 15/00

[52] U.S. Cl. ..... 355/200; 355/210; 355/233

[58] Field of Search ..... 355/200, 210, 233, 232, 355/25, 309

[56] References Cited

U.S. PATENT DOCUMENTS 3,597,074 8/1971 Murgas et al. ..... 355/25
4,357,095 11/1982 Sugawa et al. ..... 355/25 X
4,387,986 6/1983 Tsuda et al. ..... 355/25 X
4,435,068 3/1984 Landa ..... 355/309
4,506,877 3/1985 Sagiv ..... 271/127
4,660,957 4/1987 Ueda et al. ..... 355/233 X

FOREIGN PATENT DOCUMENTS 52-80840 7/1977 Japan .
56-165169 12/1981 Japan .
57-151983 9/1982 Japan .
61-15159 1/1986 Japan .

*Primary Examiner*—A. T. Grimley
*Assistant Examiner*—Sandra L. Hoffman
*Attorney, Agent, or Firm*—Fitzpatrick, Cella, Harper & Scinto

[57] ABSTRACT

The present invention provides an image forming unit which can be shifted within an image forming apparatus having an original support plate to perform an image forming operation, and which can also perform the image forming operation in combination with other device even when it is removed from the image forming apparatus, and which has multi-function and is compact.

18 Claims, 6 Drawing Sheets

IMAGE FORMING APPARATUS AND IMAGE FORMING UNIT MOUNTABLE ON SAME

BACKGROUND OF THE INVENTION

1. Field of the Invention

The present invention relates to an image forming apparatus such as an electrophotographic copying machine and the like, which utilizes an electrophotographic process, and more particularly, it relates to an image forming apparatus wherein an image forming unit is shifted in the image forming apparatus to which an original support plate is fixed, thereby forming an image.

2. Related Background Art

In an image forming apparatus such as an electrophotographic copying machine and the like, which utilizes an electrophotographic process, a surface of an original or manuscript is exposed by an exposure device to form an electrostatic latent image on a photosensitive member as an image bearing member, the electrostatic latent image is visualized as a developed image by means of a developing device, and then the developed image is transferred onto a transfer sheet by a transferring device, and the developed image transferred to the transfer sheet is fixed by a fixing device to obtain a permanent image.

Some of such image forming apparatus are so designed that the exposure device, photosensitive member, developing device and transferring device are assembled as a integral unit, and the unit is reciprocably shifted with respect to a fixed original support plate to perform a required copying operation (for example, refer to the Japanese Patent Laid-Open No. 57-151983).

However, in such a conventional image forming apparatus, since a fixing device is fixedly attached to a body of the image forming apparatus, it is necessary to devise the timing such that the transfer sheet after the transferring operation is sent to the fixing device, and thus, this apparatus has not yet been practically used. Further, even if the unit is removable with respect to the image forming apparatus, after the unit is dismounted from the image forming apparatus, the latter cannot be used for forming the image, and, and thus, thus there arises a problem that the multi-function of the unit cannot be attained.

On the other hand, in a copying machine, it is practical that the image on the original is properly focused onto the photosensitive member by the adjustment of the height of the original support glass plate, adjustment of focus of an optical lens, or the combination thereof. Accordingly, in such copying machine, once the focusing operation has been performed, the re-adjustment of the focus is not needed, so long as there is no trouble as varying the setting in use.

However, if it is assumed that the unit by which the image forming can be effected within the image forming apparatus as mentioned above and by which the image forming can also be effected outside the image forming apparatus is used, when the exchanged unit is used within the image forming apparatus and when the unit is used outside the image forming apparatus, it is necessary to adjust the focus of the optical system, respectively, and, thus, there arises a problem that the handling of the apparatus and unit becomes complicated and troublesome. In particular, when the unit dismounted from the image forming apparatus is used together with other option apparatus, an operator is subject to considerable burden.

SUMMARY OF THE INVENTION

An object of the present invention is to provide an image forming unit which can be used within an image forming apparatus to form an image and by which an image can be formed outside the image forming apparatus, and an image forming apparatus on which such image forming unit can be mounted.

Another object of the present invention is to provide an image forming unit by which an image can properly be formed not only within an image forming apparatus but also outside the image forming apparatus.

A further object of the present invention is to provide an image forming unit which has a safety mechanism for transporting an image forming apparatus including the image forming unit mounted thereon, and an image forming apparatus on which such image forming unit can be removably mounted.

Other objects and features of the present invention will be more apparent from the following description referring to the accompanying drawings.

DETAILED DESCRIPTION OF THE PREFERRED EMBODIMENTS

The present invention will now be explained in connection with the accompanying drawings.

Figure 1:
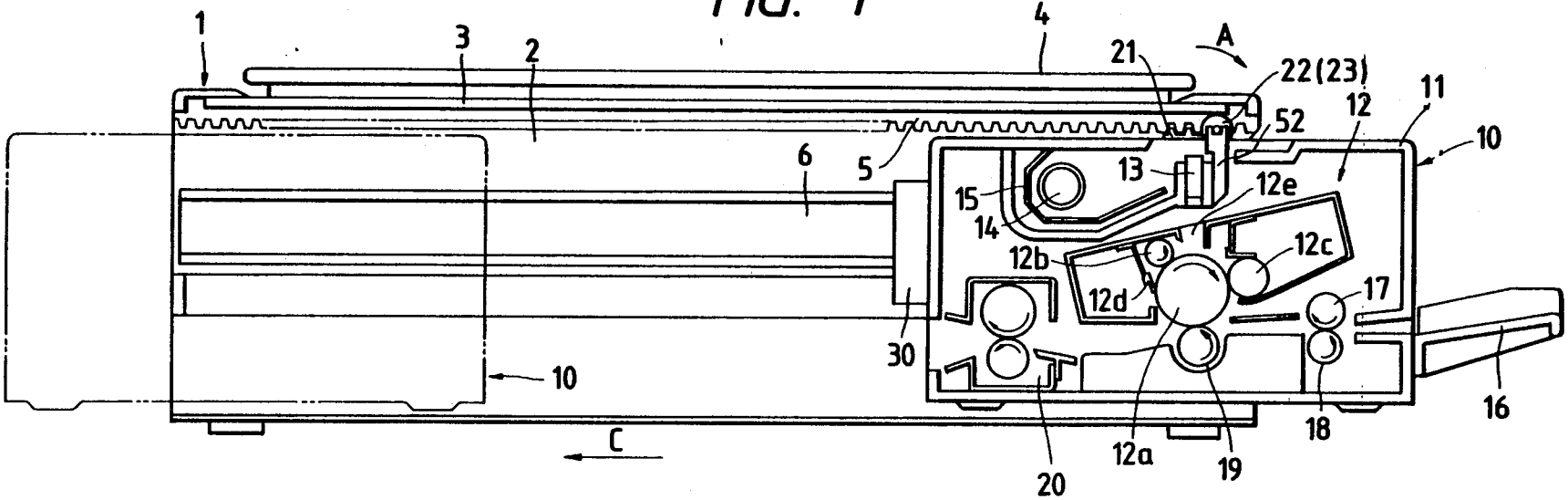
FIG. 1, is a cross-sectional view of an image forming unit which is constituted in combination with an original support plate, according to a preferred embodiment of the present invention.
Figure 2:
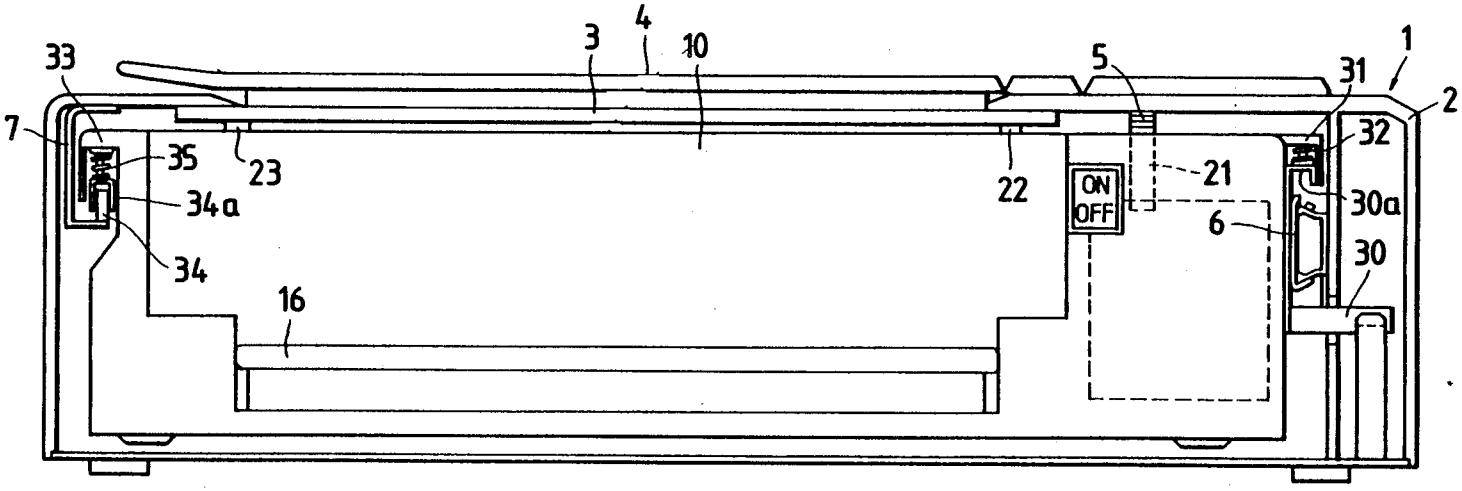
FIG. 2 is a side view of the apparatus of FIG. 1.

FIG. 1 is a cross-sectional view showing an example that the present invention is applied to a copying apparatus constituted by combining an image forming unit and a fixed original support plate, and FIG. 2 is a side view of the apparatus of FIG. 1.

In FIGS. 1 and 2, the copying apparatus 1 comprises a hollow rectangular prismatic frame 2, a flat original support glass plate 3 fixed to an upper surface of the frame 2 in parallel therewith, and a press cover plate 4 rockably mounted on an upper part of the frame 2, for pressing an original set on the original support glass plate 3 against the latter. On an inner surface of the upper wall of the frame 2, a rack 5 is fixed along one side of the frame, which rack extends in a longitudinal direction of the frame 2.

A removable image forming unit 10 includes a housing 11, a process cartridge 12 removably inserted in the housing 11, a short focus lens array 13 such as "Cell Fock Lens" (trade mark) arranged in the upper portion of the process cartridge 12 in confronting relation to the original support glass plate 3, an exposure lamp 14 for illuminating the original (not shown) set on the glass plate 3 from the underside through the glass plate in a slit pattern, a reflection mirror 15 associated with the exposure lamp, feed rollers 17, 18 for feeding a transfer sheet (image receiving member)(not shown) in a tray 16 toward the process cartridge 12, a transfer roller 19 pressed against a photosensitive drum 12*a* arranged in the process cartridge 12, and a fixing device 20 for fixing an image which is transferred to the transfer sheet by passing the transfer sheet through between the transfer roller 19 and the photosensitive drum 12*a*. These elements are driven by motors (not shown) provided in the housing 11, and appropriate circuits (not shown) provided in the housing 11 supply electric power to these elements.

Further, the process cartridge 12 is constituted by the above-mentioned photosensitive drum 12*a* driven by the above-mentioned motor, a charging roller 12*b*, a developing sleeve 12*c* arranged in a developing device, and a cleaning blade 12*d* arranged in a cleaning device. These elements 12*b*–12*d* are positioned around the photosensitive drum 12*a*. Incidentally, the reference numeral 12*e* designates an opening for exposing the image.

As shown in FIG. 2, the image forming unit 10 as constituted above is, at its one side, supported for up-and-down movement by a supporting mechanism 30 shiftable along a guide member 6 in the longitudinal direction (right and left direction in FIG. 1) of the frame 2. A compression spring 32 is arranged between a receiver portion 30*a* formed on an upper end of the supporting mechanism 30 and a support portion 31 opposed to the receiver portion 30*a* and protruded from a side wall of the image forming unit 10.

Further, on an inner surface of a side wall of the frame, which is opposed to the other side wall of the image forming unit 10, a channel-shaped guide member 7 is fixed, which guide member extends in the longitudinal direction (right and left direction in FIG. 1) of the frame 2. A guide roller 34 rolling on the guide member 7 is shiftable in an up-and-down direction and is rotatably mounted on an inverted U-shaped support member 33 formed on the other side wall of the image forming unit 10 in confronting relation to the guide member 7. Further, a compression spring 35 is arranged between an upper surface of a guide roller holder 34*a* and an inner surface of the support member 33 opposed to the holder. By bias forces of these two springs 35 and 32, the whole image forming unit 10 is biased upwardly and is held in a suspended condition within the frame 2.

The image forming unit 10 has a pinion gear 21 which is driven by the same motor (not shown) as that driving the photosensitive drum 12*a* and which can be changed over by means of an appropriate clutch (not shown) to be rotated either in a positive direction or in a reverse direction. The pinion gear 21 is meshed with the rack 5 fixed to the frame 2 so that the image forming unit 10 can be shifted within the frame 2 in the left and right direction of FIG. 1 by the rotation of the pinion gear 21.

Further, the image forming unit 10 includes a pair of positioning rollers 22 and 23 for automatically focusing the short focus lens array 13 so as to focus the image of the original supported on the original support glass plate 3 on the peripheral surface of the photosensitive drum 12*a* by positioning the image forming unit 10 in place under the original support glass plate 3. As shown in FIG. 2, each of the positioning rollers 22, 23 is situated under the original support glass plate 3 at both sides thereof in positions where these rollers do not have influence upon the copying operation. Further, as shown in FIG. 1, the positioning rollers 22, 23 are rotatably mounted on upper ends of corresponding support members 52, 53 (only one of which is shown) attached to the upper portion of the image forming unit 10 in the vicinity of the lens array 13, and are abutted against the undersurface of the original support glass plate 3 by means of corresponding compression springs 32 and 35 for biasing the image forming unit 10 upwardly, whereby the image forming unit 10 can be smoothly shifted while maintaining the image forming unit 10 by a given distance from the original support glass plate 3. Further, the lens array 13 can be properly positioned with respect to the original support glass plate 3 by means of the pair of positioning rollers 22, 23.

Next, a first mode of the copying operation performed by means of the image forming unit so arranged will be explained.

The position of the image forming unit 10 shown in FIG. 1 corresponds to a waiting position before the copying operation is started. In this condition, when the transfer sheet (not shown) is introduced into the image forming unit 10 from the tray 16, a sensor (not shown) is activated to energize the motor (not shown), thereby driving the electrophotographic elements including the photosensitive drum 12*a*, and the pinion gear 21. In this point, since the pinion gear 21 meshed with the rack 5 is rotated in a direction shown by the arrow A in FIG. 1, the image forming unit 10 is shifted in a direction shown by the arrow C in FIG. 1 along the guide members 6 and 7. At the same time, the positioning rollers 22, 23 roll on the undersurface of the original support glass plate 3, whereby the image forming unit 10 scans the original while keeping the focus of the lens array 13 with respect to the original on the glass support 3 constant.

Whenever the image forming unit 10 is shifted, since the lamp 14 is energized or illuminated, the original on the glass plate 3 is scanned in the slit pattern by means of the light emitted from the lamp 14, with the result that a portion of the original image at the scanned position is projected onto the photosensitive drum 12*a* through the short focus lens array 13, thus exposing the photosensitive drum 12*a*. In this way, the latent image corresponding to the original image is formed on the drum 12*a*. In this case, since the pinion gear 21 and the photosensitive drum 12*a* are driven by the same drive motor, even if the variation in the load occurs, there is no problem that the cycles between these elements 21 and 12*a* deviate from each other to form an undesirable image.

The latent image formed on the photosensitive drum 12*a* is changed to a toner image by supplying toner thereto by means of the developing sleeve 12*c*, and the toner image is transferred onto the transfer sheet by the transfer roller 19. The image transferred to the transfer sheet is fixed thereto by the fixing device 30, and then the transfer sheet is ejected outside the image forming unit 10.

In this way, the image forming unit 10 is shifted in the direction C within the frame 2 while performing the copying operation. When the image forming unit 10 reaches a position shown by a two-dot chain line in FIG. 1, another sensor (not shown) is activated to change over the clutch (not shown), thereby rotating the pinion gear in a direction opposite to the above-mentioned one, with the result that the image forming unit 10 is shifted in a direction opposite to the direction C to return it to the starting position. In this way, one cycle of the copying operation is completed.

The above-mentioned apparatus is of the type that the original support plate is fixed. When the image forming unit 10 is removed from the frame 2 and an original feeding device (which will be described later) is set to the image forming unit 10, the image forming unit can be used as a more small-sized copying apparatus.

Figure 3:
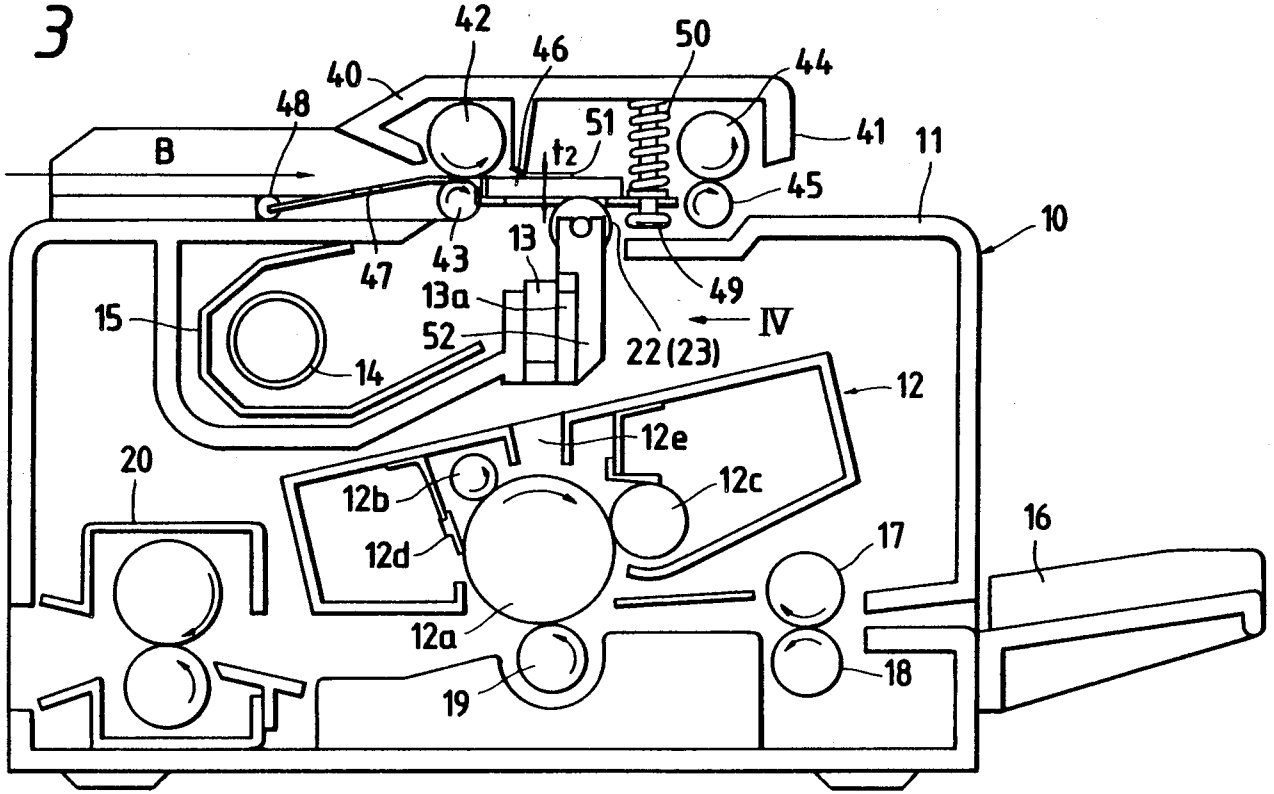
FIG. 3 is a sectional view of an image forming unit which is constituted in combination with an original feeding device, according to another embodiment of the present invention.

FIG. 3 shows a cross-sectional view of such more small-sized copying apparatus obtained by incorporating the original feeding device 40 into the image forming unit 10 removed from the copying apparatus 1 of FIG. 1.

In FIG. 3, the original feeding device 40 includes a housing 41 arranged on the upper surface of the image forming unit 10. Feed rollers 42 and 43 are arranged at an original insertion side of the housing 41, and ejector rollers 44 and 45 are arranged at an original ejection side of the housing 41. The feed rollers 42, 43 and ejector rollers 44, 45 are driven in synchronous with the pinion gear 21 (refer to FIG. 1).

Further, an original support glass plate 46 is arranged on a surface of the housing 41 opposed to the upper surface of the image forming unit 10 in confronting relation to the short focus lens array 13 and the positioning rollers 22, 23 (only one of which is shown) of the image forming unit 10. The original support glass plate 46 is fixed to a holder 47. The holder 47 is so shaped as to act as a guide for guiding the original to the feed rollers 42, 43, and is pivotally mounted on the housing 41 by means of a pin 48 at its one end near the original insertion side. A free end of the holder 47 has an opening through which vertical guide rods 49 extend, whereby the free end of the holder 47 can move in an up-and-down direction along the guide rods. Further, compression springs 50 are arranged between the pivotable free end of the holder 47 and an inner surface of the housing 41 opposed to the free end of the holder. By urging the original support glass plate 46 against the positioning rollers 22, 23 by means of the compression springs 50, the focus of the lens array 13 with respect to the original passing through on the glass plate 46 can be kept constant.

Incidentally, the guide rods 49 and compression springs 50 should be situated at side positions where they do not interfere with the original; and, thus, these elements 49, 50 are provided in pair, respectively. Further, an original pressor 51 is provided for pressing the original on the glass support 46. Incidentally, in FIG. 3, the same elements as those shown in FIG. 1 are designated by the same reference numerals as those used in FIG. 1.

Next, a second mode of the copying operation performed by copying apparatus so arranged will be explained.

When the transfer sheet is introduced into the image forming unit 10 from the tray 16, a sensor (not shown) is activated to bring the image forming unit 10 in a waiting condition. In this condition, when the original reaches the nip between the feed rollers 42, 43 of the original feeding device 40, another sensor (not shown) is activated to initiate the copying operation. In this way, when the drive motor (not shown) in the image forming unit 10 is energized, the electrophotographic elements including the photosensitive drum **12*a* and the pinion gear 21 are rotated, thus rotating the feed rollers 42, 43 and the ejector rollers 44, 45 in the directions shown by the arrows in FIG. 3, with the result that the original is fed in the direction shown by the arrow B in FIG. 3**.

As the original is shifted on the original support glass plate 3 while being pressed against the latter by means of the original pressor 51, since the lamp 14 is being illuminated, the original is scanned in the slit pattern, whereby the original image at the scanned position is focused on the photosensitive drum **12*a* through the short focus lens array 13, thus exposing the drum 12*a***.

Incidentally, the performance or movement of the transfer sheet in the image forming unit 10 is the same as in the case of the embodiment shown in FIG. 1.

Further, in the illustrated embodiments, the position of the positioning rollers 22 and 23 is so adjusted that the lens array 13 is correctly focused on the original disposed on the original support glass plate 3 or 46 at a position where the average thickness of the glass plate is considered.

Figure 4:
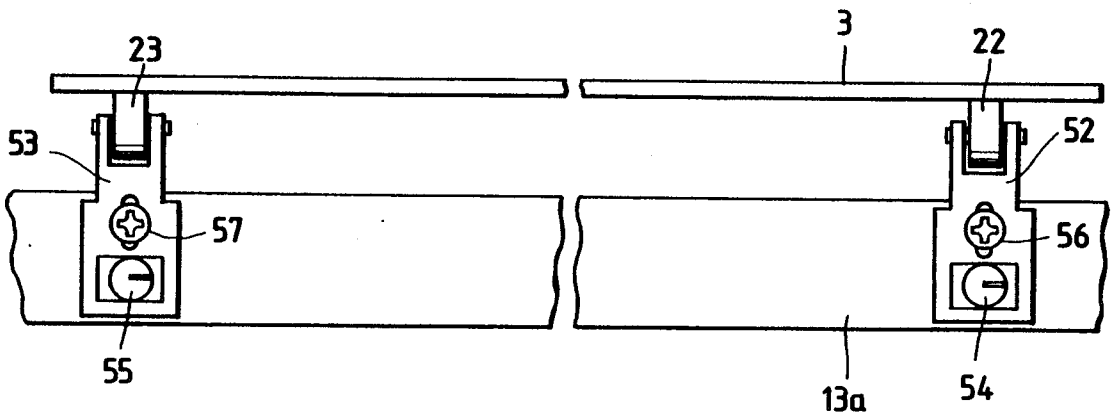
FIG. 4 is a partial side view of positioning rollers looked at from the arrow IV of FIG. 3.

FIG. 4 shows the details of the positioning rollers looked at from the direction shown by the arrow IV of FIG. 3.

In FIG. 3, after the position of each of holders 52 and 53 for supporting the corresponding positioning roller 22, 23 with respect to the original support glass plate 3 is adjusted by rotating each of corresponding eccentric cams 54, 55 rotatably mounted on a lens array support member **13*a* of the image forming unit 10, the holders are fixed to the lens array support member by screws 56 and 57**.

As mentioned, in the illustrated embodiment, since the positioning rollers 22, 23 abutted against the original support glass plate are provided on the image forming unit 10, merely once the image forming unit 10 has been set in the frame 2 having the original support plate or merely once the original feeding device 40 has been set on the image forming unit 10, the lens array 13 can be focused on the surface of the original automatically. In this case, the variation of the distance between the surface of the original and the lens array 13 only depends upon the thickness of the original support glass plate 3 or 46.

Therefore, when the image forming unit 10 which can constitute the copying apparatus in the combination with the original support plate is used (as it is) for constituting the small-sized copying apparatus in combination with the original feeding device 40, in the illustrated embodiment, the dispersion in the thickness of the original support glass plate 46 of the original feeding device 40 is about $\pm 0.1$ mm. Within the range of such dispersion, there is no problem since the focal depth of the short focus lens array 13 exists in a range of $\pm 0.2$ mm.

On the other hand, the dispersion in the position of the rollers 22, 23 due to dimensional error in the pivot portion (pin 48) of the holder 47 will be about ±0.2 mm. However, in the illustrated embodiment, since the distance between the pin 48 and an optical axis of the short focus lens array 13 is 36 mm and the distance between the short focus lens array 13 and the rollers 22, 23 is 5 mm, the variation or dispersion of the height of the original support glass plate 46 on the optical axis of the short focus lens array 13 caused by the dispersion in the position of the pin 48 in a condition that the original support glass plate 46 is abutted against the rollers 22, 23 will be:

$$0.2\times5/(36+5)=0.024 \text{ mm}$$

Such dispersion will not exert a bad influence upon the focus of the lens array 13. Accordingly, even when the original feeding device 40 is exchanged to any other original feeding device, there is no disarrangement in the focusing condition of the lens array 13.

Further, in the case where the image forming unit is used in combination with the original support glass plate, since the dispersion in the thickness of the original support glass plate 3 is about ±0.1 mm, the surface of the original is included within the focal depth of the short focus lens array 13, and, therefore, even if the original support glass plate is changed to any other original support glass plate, there is no disarrangement in the focusing condition of the lens array 13.

Figure 5:
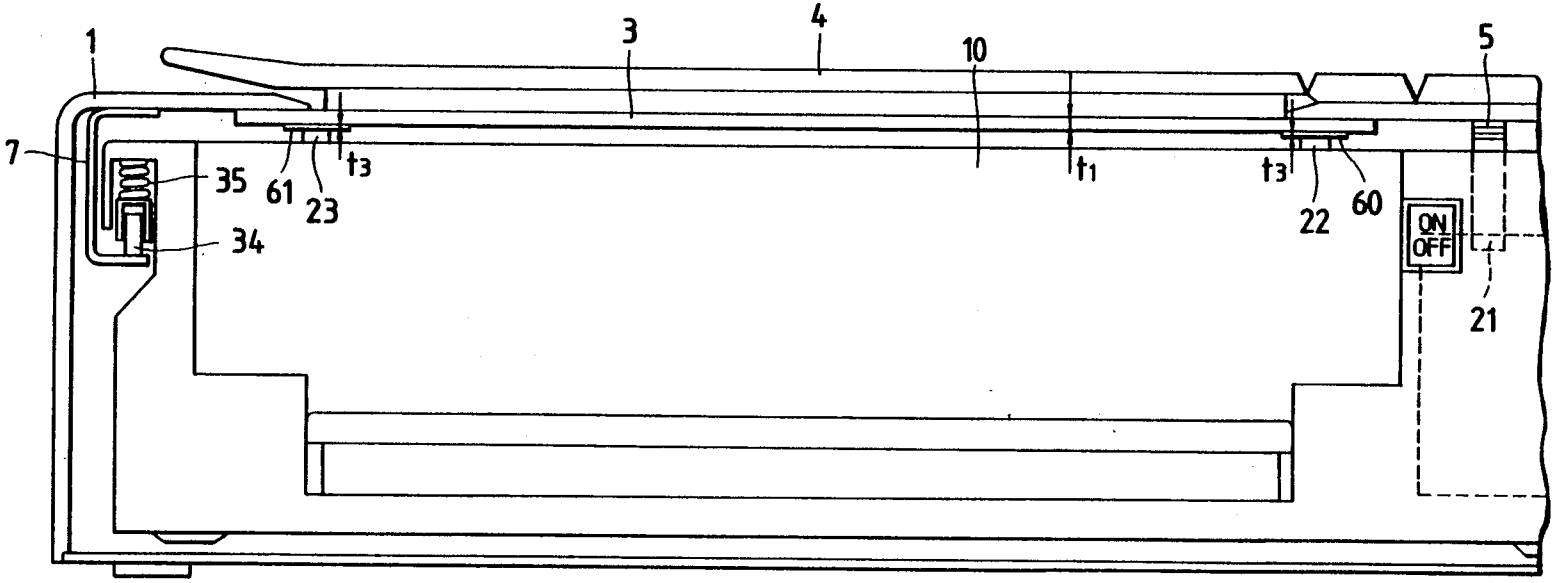
FIG. 5 is a partial side view of an original support glass plate against which the positioning rollers are abutted, according to another embodiment of the present invention.

FIG. 5 is a side view showing a portion of a copying apparatus with an original support plate according to another embodiment of the present invention.

In FIG. 5, elements corresponding to those shown in FIGS. 1 and 2 are designated by the same reference numerals as those used in FIGS. 1 and 2, and elements different from those shown in FIGS. 1 and 2 will mainly be explained.

In this embodiment, the thickness $t_1$ of the original support glass plate 3 is thinner than the thickness $t_2$ of the original support glass plate 46 of the original feeding device 40 in order to ensure the mechanical strength of the original support glass plate 46 of the original feeding device 40.

In this case, in order to ensure the focusing condition of the lens array with respect to both the copying apparatus 1 and the original feeding device 40, sheets 60 and 61 each having a thickness $t_3$ are fixed to the undersurface of the original support glass plate 3 of the copying apparatus 1 against which the positioning rollers 22 and 23 are abutted, whereby, even when the thickness of the glass plate 3 is changed, the exchangeability between the copying apparatus 1 and the original feeding device 40 with respect to the image forming unit 10 is ensured without re-adjustment of the focus of the lens array.

Incidentally, when the thickness of the original support glass plate 3 is thinner than that of the original support glass plate 46, if the index of refraction of the glass plate is n, the length of a light path of the glass having a thickness t will be $(2-1/n)t$. Accordingly, when the thickness $t_3$ of the sheets 60, 61 is set to have a value of $$t_3=(2-1/n)t_2-(2-1/n)t_1=(2-1/n)(t_2-t_1),$$

since the accuracy of the sheet thickness $t_3$ can be ensured within a range of ±0.02 mm or less, there is no bad influence.

As explained above, the image forming unit can be used within the copying apparatus having the original support plate. And, when the image forming unit is removed from such copying apparatus, it can also be used in combination with the original feeding device to form the image.

Further, since the positioning members (rollers) acting on the original support glass plate of the copying apparatus or the original feeding device separately used in combination with the image forming unit are provided in the image forming unit, the focus of the lens array of the image forming unit with respect to the surface of the original can always be maintained constant, and, accordingly, even when any copying apparatus or original feeding device is used with respect to the image forming unit, it is not needed to adjust the focus of the lens array again.

Next, a safety mechanism used when the whole copying apparatus is transported in a condition that the image forming unit is mounted within the frame 2 of the apparatus will be explained.

Figure 6:
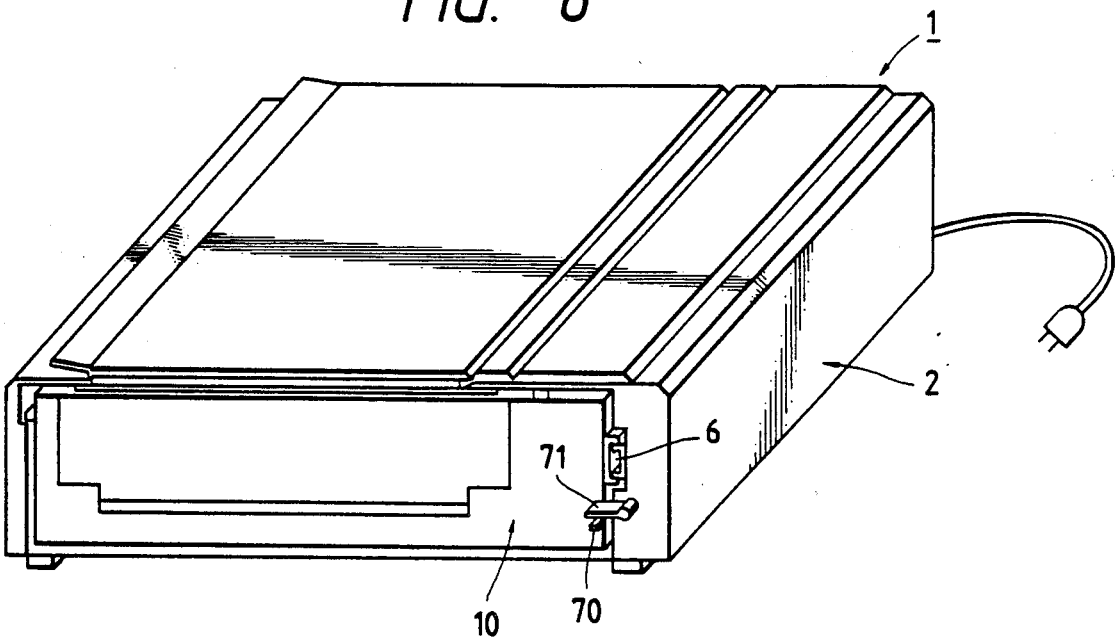
FIG. 6 is a perspective view of a copying apparatus, for explaining a safety mechanism.

As shown in FIG. 6, in the vicinity of an opening of the frame 2, a power source switch 70 and a fixing member 71 constituting a fixing or locking mechanism are arranged adjacent to each other. These elements 70, 71 form a safety mechanism according to the present invention.

Figure 7:
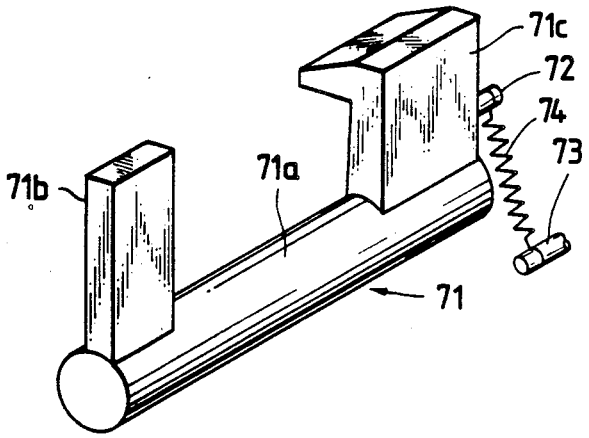
FIG. 7 is a perspective view of a fixing member.
Figure 8:
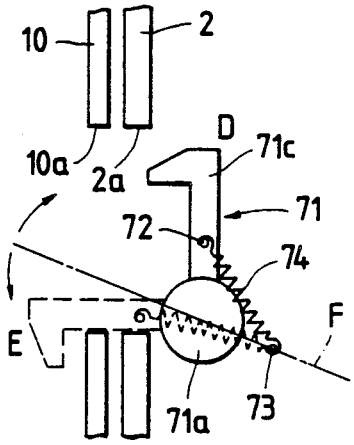
FIG. 8 is a view showing an operation of a hook of the fixing member.

As shown in FIG. 7, the fixing member 71 comprises a fixing lever **71*b* and a hook 71*c* both of which are fixed to both ends of a rotatable shaft 71*a* in alignment with each other. The whole fixing member 71 can be rotated together with the shaft 71*a*. A pin 72 protruded from a side wall of the hook 71*c* of the fixing member 71 is connected to a pin 73 fixed to the frame 2 through the medium of a spring 74, by which the hook 71*c* (and accordingly the fixing lever 71*b*) can be positioned either in a position D or a position E situated on opposite sides with respect to a line F connecting between centers of the pin 73 and of the shaft 71*a*, as shown in FIG. 8. When the hook 71*c* is positioned in the position D shown by a solid line, the image forming unit 10 is released from the fixing mechanism, whereas, when the hook 71*c* is positioned in the position E shown by a phantom line (by rotating by 90° through a hole 2*a* of the frame 2 and a hole 10*a* of the image forming unit 10), the hook 71*c* is engaged by the hole 10*a* of the image forming unit 10**, thus fixing or locking the image forming unit by means of the fixing mechanism.

The fixing member 71 constituting the fixing mechanism cooperates with the power source switch 70. The relation between these elements 70 and 71 will be explained with reference to FIGS. 9A, 9B, 10A and 10B. Incidentally, FIGS. 9A and 10A are plan views, and FIGS. 9B and 10B are side views.

Figure 9A:
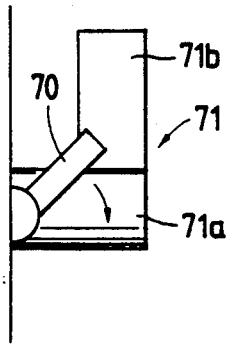
FIGS. 9A, 9B, 10A and 10B are schematic views showing cooperation between a fixing lever and a power source switch.
Figure 9B:
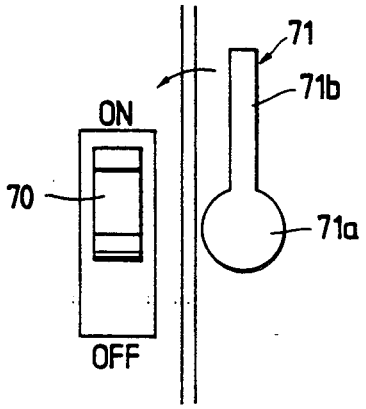
Figure 10A:
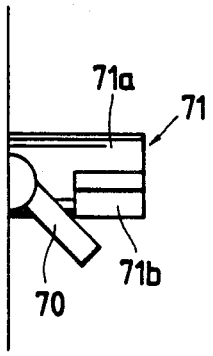
Figure 10B:
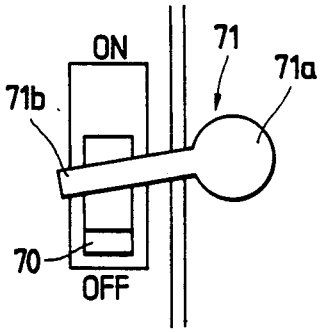

FIGS. 9A and 9B show a condition that the fixing mechanism is inoperative. In this condition, the fixing lever **71*b* is cocked in an upright position, and the power source switch 70 is in an ON condition, thus permitting the copying operation. That is to say, when the power source switch 70** is in the ON condition to permit the copying operation, since the image forming unit is released from the fixing mechanism to move freely, the copying operation is not disturbed.

When the fixing lever **71*b* is rocked from the condition of FIGS. 9A, 9B**, to a condition shown in FIGS.

10A, 10B, the power source switch 70 is engaged by the fixing lever 71*b* and is turned OFF a shown. Consequently, the image forming unit 10 is fixed or locked, thus unabling the copying operation. Therefore, when the copying apparatus is transported, since the image forming unit 10 is locked, the image forming unit 10 is prevented from moving at random within the frame 2 and/or from flying out of the frame 2.

Further, when the power source switch 70 is turned ON from the condition shown in FIGS. 10A, 10B, the fixing lever 71*b* which has been engaged by the switch 70 returns to the position shown in FIGS. 9A, 9B, thus releasing the image forming unit from the fixing or locking mechanism to permit the copying operation.

As mentioned above, in the illustrated embodiment, since the copying operation cannot be performed while locking the image forming unit 10, the damage of the fixed parts of the image forming unit 10 and/or the driving mechanism comprising the rack 5, pinion 21 and the like can be positively prevented.

Next, a safety mechanism according to another embodiment will be explained with reference to FIGS. 11 to 14. Incidentally, FIG. 11 shows a perspective view of the copying apparatus according to this embodiment, FIG. 12 is a perspective view showing the relation between an arm of the power source switch and electric contact springs, and FIGS. 13 and 14 are views for explaining the operation of the power source switch.

Figure 11:
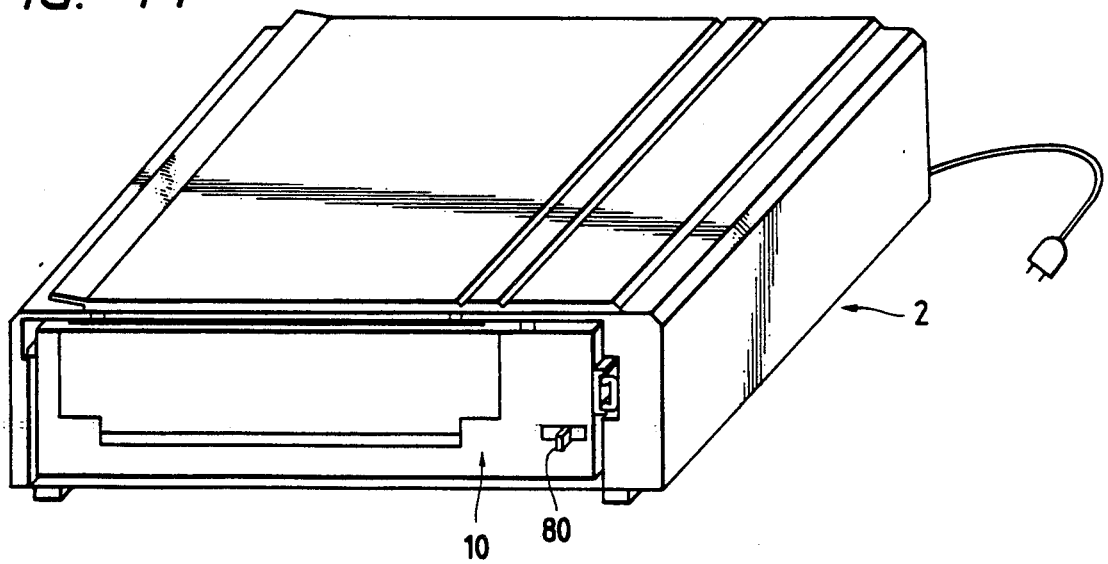
FIG. 11 is a perspective view of a copying apparatus, for explaining a safety mechanism according to another embodiment.
Figure 12:
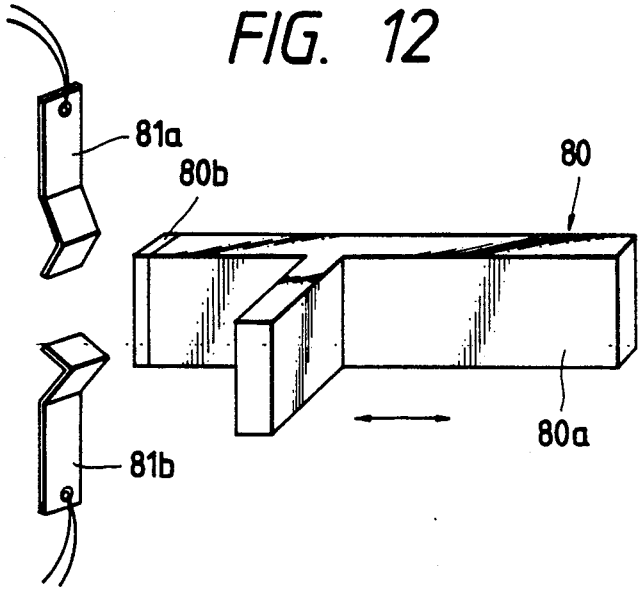
FIG. 12 is a perspective view showing a relation between an arm of the power source switch and contact springs.

In the illustrated embodiment, as shown in FIG. 11, a power source switch 80 is attached to the image forming unit 10. As shown in FIG. 12, the power source switch 80 comprises an arm 80*a* and a contact portion 80*b*.

Figure 13:
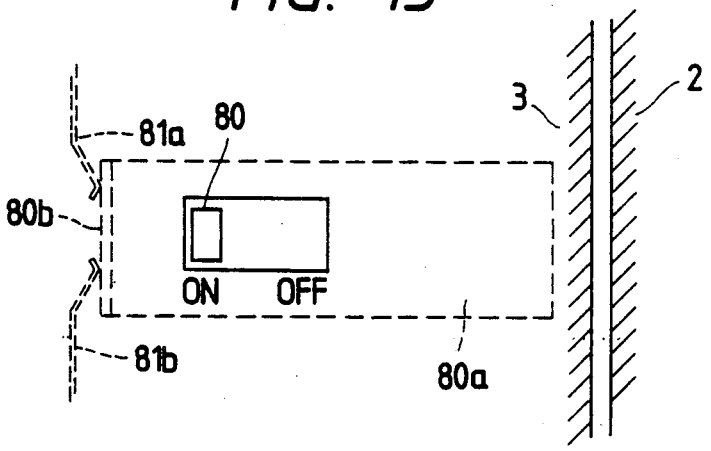
FIGS. 13 and 14 are views for explaining the operation of the power source switch.
Figure 14:
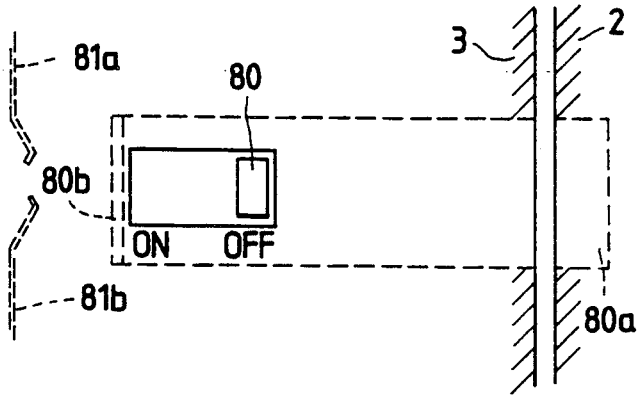

When the power source switch is in an ON condition as shown in FIG. 13, the contact portion 80*b* of the power source switch 80 is abutted against the electric contact springs 81*a* and 81*b* to permit the copying operation, and the arm 80*a* is completely retracted into the image forming unit 10 to permit the free movement of the image forming unit 10 within the frame 2.

In the illustrated embodiment, the same technical effect as that in the previous embodiment can be obtained; particularly, in the illustrated embodiment, the power source switch is formed integrally with the fixing lever, the number of parts is reduced, thus simplifying the construction.

As mentioned, when the copying operation is prepared by turning the power source switch ON, since the image forming unit 10 in the frame 2 is released from the fixing mechanism in synchronous with such switching operation, the copying operation cannot be effected while locking the image forming unit, thus positively preventing the damage of the fixed parts of the unit and/or the drive mechanism for shifting the image forming unit.

Further, when the power source switch is turned OFF, since the image forming unit is locked by the fixing mechanism, in the transportation of the copying apparatus the image forming unit is prevented from randomly moving within the frame of the apparatus and from flying out of the frame.

We claim:

1. An image forming apparatus comprising:

an original support plate for supporting an original:

an image forming unit removably mountable on the image forming apparatus, said image forming unit including an image bearing member on which a latent image corresponding to the original is formed, means for forming the latent image on said image bearing member, means for developing the latent image, means for transferring a developed image on said image bearing member onto an image receiving member, and means for fixing a transferred image on said image receiving member; and means for shiftably guiding said image forming unit along said original support plate;

wherein said image forming unit can be selectively set (a) in a first mode in which said image forming unit is shifted in the image forming apparatus to perform an image forming operation or (b) in a second mode in which said image forming unit is separated from the image forming apparatus and performs the image forming operation while in a stationary position.

2. An image forming apparatus according to claim 1, wherein, when said image forming unit is separated from the image forming apparatus, an original feeding device can be attached to said image forming unit.

3. An image forming apparatus according to claim 2, wherein said image forming unit includes distance setting means for setting a distance between said original support plate and said image forming unit in said first mode and a distance between said original feeding device and said image forming unit in said second mode to a predetermined value, and wherein said setting means commonly sets the distance in the first and second modes.

4. An image forming apparatus according to claim 3, wherein said image bearing member in said image forming unit comprises a photosensitive member, wherein said means for forming said latent image in said image forming unit include optical means for projecting a light image corresponding to the original onto said photosensitive member and means for supporting said optical means to said images forming unit, and wherein said distance setting means is attached to said means for supporting said optical means.

5. An image forming apparatus according to claim 4, wherein said original support plate comprises a first transparent glass plate, wherein said original feeding device comprises a second transparent glass plate, and wherein said distance setting means comprise a pair of rotary members abutting against said first transparent glass of said original support plate or said second transparent glass plate of said original feeding device.

6. An image forming apparatus according to claim 3, wherein said image forming unit includes adjuster means for adjusting the distance to be set by said distance setting means.

7. An image forming apparatus according to claim 1, further comprising a power source switch, and wherein said image forming apparatus includes locking means acting on said image forming unit in association with ON/OFF operations of said power source switch, so that when said power source switch is turned OFF said locking means lock said image forming unit in the image forming apparatus and when said power source switch is turned ON said locking means release said image forming unit to be freely moved in the image forming apparatus.

8. An image forming apparatus according to claim 7, wherein said power source switch is provided on said image forming unit.

9. An image forming apparatus according to claim 4, wherein said optical means comprise a short focus lens array.

10. An image forming unit removably mountable on an image forming apparatus, comprising:

an image bearing member on which a latent image corresponding to an original is formed;

latent image forming means for forming the latent image on said image bearing member;

developing means for developing the latent image;

transfer means for transferring a developed image on said image bearing member onto an image receiving member;

fixing means for fixing a transferred image on said image receiving member; and a housing for integrally supporting said image bearing member, said latent image forming means, said developing means, said transfer means and said fixing means;

wherein said image forming unit can be selectively set (a) in a first mode in which the image forming unit is shifted in the image forming apparatus, having an original support plate, along said original support plate to perform an image forming operation or (b) in a second mode in which the image forming unit is separated from the image forming apparatus and performs the image forming operation while in a stationary position.

11. An image forming unit according to claim 10, wherein when the image forming unit is separated from the image forming apparatus, an original feeding device can be attached to the image forming unit.

12. An image forming unit according to claim 11, wherein said image forming unit includes distance setting means for commonly setting a distance between said original support plate and said image forming unit in said first mode and a distance between said original feeding device and said image forming unit in said second mode to a predetermined value, respectively, and wherein said setting means commonly sets the distance in the first and second modes.

13. An image forming unit according to claim 12, wherein said image bearing member in said image forming unit comprises a photosensitive member, wherein said means for forming said latent image in said image forming unit include optical means for projecting a light image corresponding to the original onto said photosensitive member, and a means for supporting said optical means to said image forming unit, and wherein said distance setting means is attached to said means for supporting said optical means.

14. An image forming unit according to claim 13, wherein said original support plate further comprises a first transparent glass, wherein said original feeding device comprises a second transparent glass, and wherein said distance setting means comprise a pair of rotary members abutting against said first transparent glass of said original support plate or said second transparent glass plate of said original feeding device.

15. An image forming unit according to claim 12, wherein said image forming unit includes adjuster means for adjusting the distance to be set by said distance setting means.

16. An image forming unit according to claim 10, further including a power source switch.

17. An image forming unit according to claim 13, wherein said optical means comprises a short focus lens array.

18. An image forming unit removably mountable on an image forming apparatus, comprising:

an image bearing member on which a latent image corresponding to an original is formed, said image bearing member having a photosensitive layer;

latent image forming means for forming the latent image on said image bearing member, said latent image forming means including optical means for projecting a light image corresponding to the original onto said image bearing member;

developing means for developing the latent image;

transfer means for transferring a developed image on said image bearing member onto an image receiving member;

fixing means for fixing a transferred image on the image receiving member;

distance setting means for setting a distance between the optical means and the original to a predetermined value; and a housing for integrally supporting said image bearing member, said latent image forming means, said developing means, said transfer means, said fixing means and said distance setting means;

wherein said image forming unit can be selectively set (a) in a first mode in which the image forming unit is shifted in the image forming apparatus, having an original support plate, along said original support plate to perform an image forming operation or (b) in a second mode in which the image forming unit is separated from the image forming apparatus and performs the image forming operation while in in a stationary position, and wherein said distance setting means commonly act on the original in the first and second modes.

* * * * *